US005155954A

United States Patent [19]

Roire

[11] Patent Number: 5,155,954

[45] Date of Patent: Oct. 20, 1992

[54] DEVICE FOR TEMPORARY RETENTION OF A LIFTING ELEMENT ON A METAL SURFACE OF A FORM DURING THE CONCRETE POURING AND SETTING PHASES OF A PREFABRICATED CONCRETE MEMBER

[75] Inventor: Pierre Roire, Lyons, France

[73] Assignee: Etablissements A. Mure, Lyon, France

[21] Appl. No.: 833,042

[22] Filed: Feb. 10, 1992

[30] Foreign Application Priority Data

Feb. 8, 1991 [FR] France ..... 91 01916

[51] Int. Cl.[5] ..... E04H 12/34

[52] U.S. Cl. ..... 52/125.5; 52/125.1; 249/190; 249/202; 249/205; 264/333; 264/336; 294/89

[58] Field of Search ..... 52/125.1, 125.5, 701, 52/706, 707, 125.4, 125.2, 125.3; 294/88, 89; 249/190, 202, 205; 264/333, 334, 336

[56] References Cited

U.S. PATENT DOCUMENTS

| | | | |
|---|---|---|---|
| 3,861,106 | 1/1975 | Erhart | 52/125.4 X |
| 3,883,170 | 5/1975 | Fricker et al. | 294/89 X |
| 4,173,856 | 6/1987 | Fricker | 52/125.5 |
| 4,296,909 | 10/1981 | Haeussler | 52/125.4 X |
| 4,367,892 | 1/1983 | Holt | 52/125.5 X |
| 4,386,486 | 6/1983 | Holt et al. | 52/125.5 |
| 4,538,850 | 9/1985 | De Vito | 52/125.2 X |
| 4,580,378 | 4/1986 | Kelly et al. | 52/125.5 |
| 4,671,554 | 6/1987 | Lancelot | 294/89 |
| 4,821,994 | 4/1989 | Fricker | 52/125.5 X |
| 4,930,269 | 6/1990 | Kelly et al. | 52/125.5 |

*Primary Examiner*—Richard E. Chilcot, Jr.
*Assistant Examiner*—Creighton Smith
*Attorney, Agent, or Firm*—Oliff & Berridge

[57] ABSTRACT

A device for temporary retention of a lifting element on a metal surface of a form during the concrete pouring and setting phases of a prefabricated concrete member includes a part which is designed to form a depression in a concrete section and is equipped with magnets for attachment to a metal surface of a form. The device includes a part having a flat face, a recess terminating at a face opposite the flat face and orthogonal thereto desinged to permit passage with sealing action of a lifting element, and a slot terminating in the flat face. A locking element is mounted in the slot and pivots around an axis transverse to the slot. The locking element has a hook which forms a bolt designed to ensure retention of a free end of the lifting element when the locking element is in an unlocked position in the slot.

10 Claims, 2 Drawing Sheets

DEVICE FOR TEMPORARY RETENTION OF A LIFTING ELEMENT ON A METAL SURFACE OF A FORM DURING THE CONCRETE POURING AND SETTING PHASES OF A PREFABRICATED CONCRETE MEMBER

BACKGROUND OF THE INVENTION

The present invention relates to a device for temporarily holding a lifting element on a metal surface of a form, during concrete pouring and setting phases of a prefabricated concrete member.

Handling of prefabricated reinforced concrete members requires the provision of lifting points of a sufficient number and correctly positioned in the members such that the reinforced concrete members remain stable when moved. The lifting points can be composed, depending on the configuration of the reinforced concrete parts, of either simple mild steel pins or by a variety of specific lifting elements, embedded in the concrete, associated with or without a reinforcing bar for anchoring.

The lifting systems in current use, use three technologies:

a sling screwed to a threaded socket;

a sling hooked into an anchor with an eye; and a sling hooked into an anchor with a head.

In the case where the lifting element is composed of a threaded socket, it is proper during the molding of the concrete and the setting time thereof to ensure attachment of the socket to the form using suitable means, provided the forms can be made of wood, synthetic material or, more generally, metal. Known means permitting temporary holding of a threaded socket are composed for example of a simple bolt traversing the form and providing a grip for the socket by its threads. This method of attachment destroys the form and requires repairs for subsequent use, the repairs being long and expensive.

According to another possibility, the support for the socket does not pass through the form and is composed of a part that serves to hold the socket and a part that serves to hold the form temporarily. This socket support can be made of a single material, synthetic material or metal, for attachment to a wooden form, or from a material that has magnetic inclusions, a plurality of small magnets or a single magnet of larger diameter, for attachment to a metal form. The connection between the temporary socket support and the socket is produced by introducing a cylindrical part which can be threaded, or smooth, into the interior of the socket body. However, the systems with a smooth cylindrical part which lock by friction have the disadvantage of permitting the laitance to penetrate the threads of the socket when the concrete is being poured, especially when the latter is being vibrated. The laitance then hardens and prevents normal attachment of the sling by screwing. The poor engagement which then occurs often results in disengagement of the socket from the sling and consequently causes the concrete part being handled to fall, which poses serious risks to the personnel doing the handling. This lifting system is therefore in decreasing use.

Known means which permit temporary holding inside a form utilizing anchors with eyes and anchors with heads are as follows:

the hemispherical type made of polystyrene attached by gluing to the form and used only once; the hemispherical type made of steel, attached by screwing or welding, which damages the form and necessitates a prolonged and expensive repair for reuse; and the hemispherical type made of flexible synthetic material requiring drilling of the form, and having the additional disadvantage of very rapid wear with a very limited number of applications due to the means for removal from the form which produce very high localized stresses in the material constituting the attachment.

SUMMARY OF THE INVENTION

A goal of the present invention is to provide a device which overcomes the disadvantages of known devices and provides temporary attachment to a metal form of lifting elements, and especially anchors with eyes and anchors with heads, which is reliable and resistant, which does not damage the form, which offers ease of removal from the form, which provides a seal that prevents penetration of the laitance, and which does not undergo any deformation when it is installed or removed from the molded member.

To this end, the device in accordance with the present invention comprises a part having a flat face designed to abut a metal surface of a form, the face being equipped with magnets and extended by a shaped part designed to produce a depression in the concrete part. The part comprises: a section that opens into a face opposite the flat face and orthogonal thereto; a recess designed to permit passage (with a seal) of a lifting element; a slot terminating in its flat face in which there is mounted, so as to be pivotable around an axis running transversely to the slot, a locking element or latch having a hook portion which forms a bolt designed to ensure retention of a free end of the lifting element when the locking element is in a retracted position in the slot; and means provided to ensure movement of the locking element from a locked position into an unlocked position.

In practice, when the hook portion forming the bolt is in the unlocked position, the lifting element is introduced into the interior of the shaped part, then the bolt is closed, and the assembly is attached to the form by the action of the magnets. After pouring and setting of the concrete, and removal from the form, the element forming the bolt is moved in a direction that frees the lifting element, and the shaped part is withdrawn from the concrete part, leaving a depression into which the lifting element fits.

According to one characteristic of the invention, the part designed to produce the depression is made of a rigid and non-brittle synthetic material. In addition, the magnets associated with the part forming the depression are at least two in number and are arranged symmetrically relative to an area thereof designed to receive the lifting element. Advantageously, the flat face of the part designed to form the depression is delimited by a peripheral shoulder turned toward the metal surface of the form, designed to prevent penetration of the laitance at the flat face. According to a preferred embodiment, the part designed to make the depression has a generally hemispherical shape whose bottom, in the form of a hull, has an edge delimited by essentially flat surfaces. The shape of the part designed to form the depression facilitates its withdrawal from the concrete, avoiding a suction cup effect.

According to another characteristic of the invention, the axis of articulation of the locking element or latch is located essentially mid-way along the length of the slot designed to receive it, essentially in the extension of the lifting element. The locking element comprises a shaped part that forms a ramp which, during the pivoting of the locking element toward its unlocking position, is intended to abut an upper edge of the lifting element. Thus, during tilting of the locking element toward its unlocked position, the part of the locking element that forms the ramp abuts the upper edge of the lifting element, thus promoting disengagement of the shaped part from the depression which it has just formed in the concrete.

Preferably, means designed to ensure operation of the locking element comprise a ring, mounted with articulation on the locking element around an axis parallel to an axis of articulation of the locking element near an end of the locking element designed to project from the slot in the unlocked position. The ring is retractable along the flat face of the shaped part when the latter is attached to a metal form surface. These means for operating the locking element have a simple design and high efficiency, since they do not require the use of an additional element or specific tools.

According to a first possibility, when the lifting element is composed of an anchor with an eye, in other words an element whose end has a rectangular cross section and has a transverse hole, the locking element comprises a part in the shape of a hook designed to pass through this hole, with the recess made in the shaped part having a rectangular cross section corresponding to that of the end of the lifting element, and its edge is delimited by a shoulder designed to abut in sealing fashion the end of the lifting element.

According to another possibility, when the lifting element is composed of an anchor with a head, in other words one whose end is composed of a cylindrical rod equipped with an enlarged head, the locking element comprises a part in the shape of a fork designed to overlap the rod and to abut below the head of the lifting element. The recess made in the shaped part has a circular section adapted to the section of the enlarged head, and a split collar surrounding the rod of the anchor is designed to ensure tightness between the rod and the bottom of the shaped part.

BRIEF DESCRIPTION OF THE DRAWINGS

The invention will be better understood from the following description which refers to the attached drawings which show as non-limiting examples, two embodiments of this device.

DETAILED DESCRIPTION OF PREFERRED EMBODIMENTS

Figure 1:
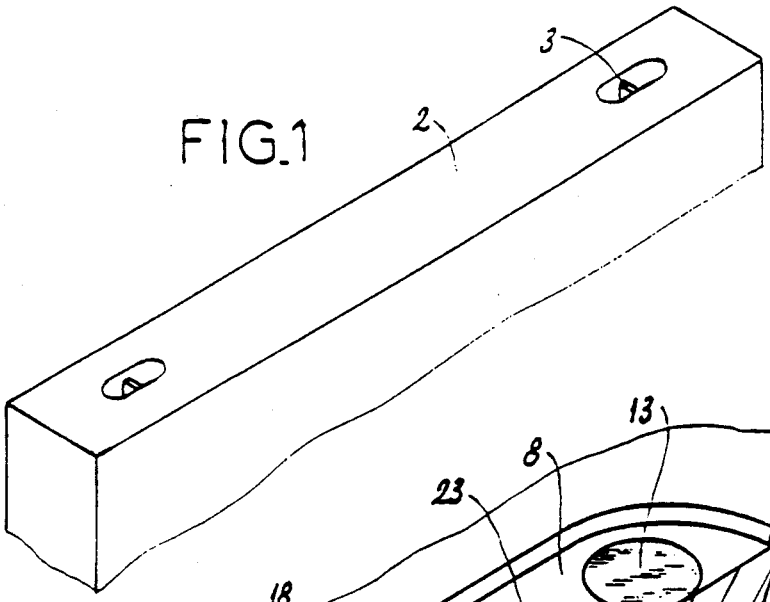
FIG. 1 is a perspective view of a portion of a concrete part equipped with two lifting elements according to the present invention.
Figure 2:
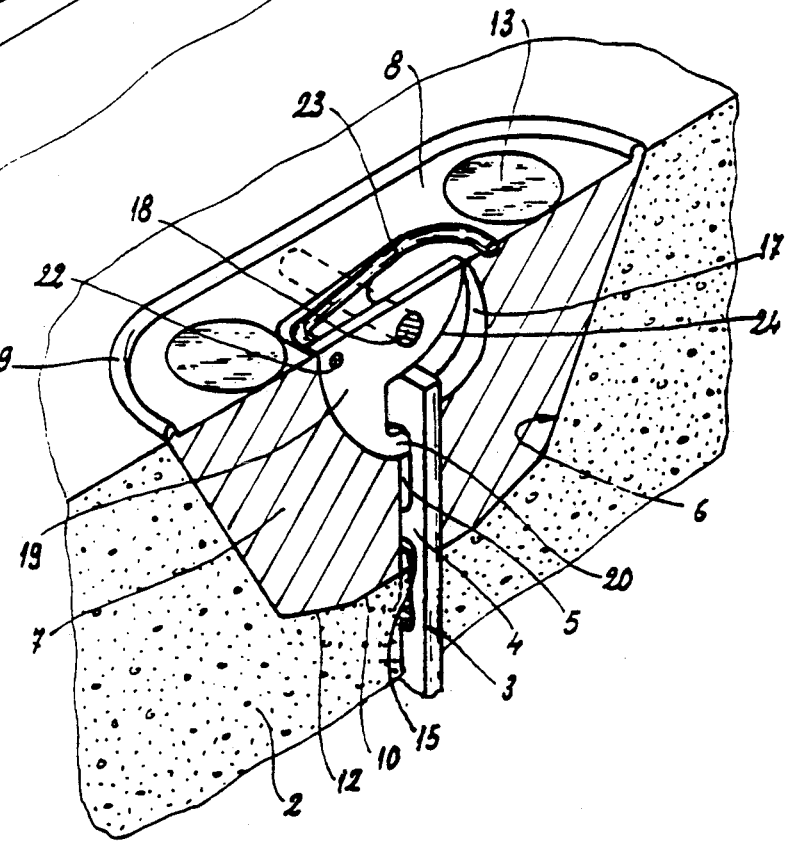
FIG. 2 is a perspective view on an enlarged scale and partially in lengthwise section of a lifting element device according to the present invention.
Figure 3:
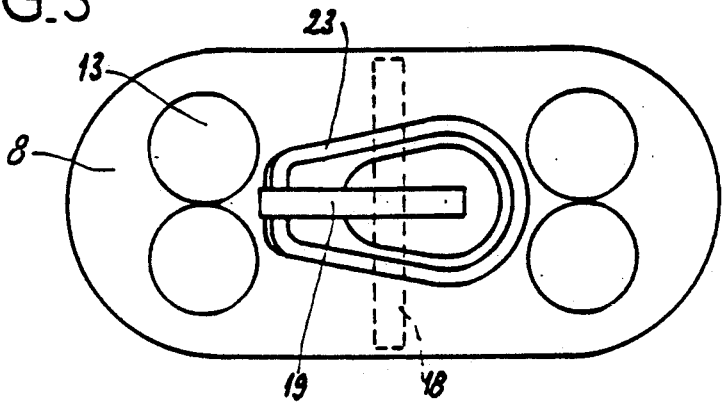
FIG. 3 is a front view of the flat face of the device shown in FIG. 2.

FIG. 1 shows a member 2 made of reinforced concrete, provided with two lifting elements 3, composed for example of anchors with eyes. FIG. 2 shows an anchor with an eye designated by general reference numeral 3 whose free end 4 has an essentially rectangular section and is traversed by a transverse hole 5 or an eye. End 4 of anchor 3 is designed to project into the bottom of a depression 6 formed in member 2.

Figure 4:
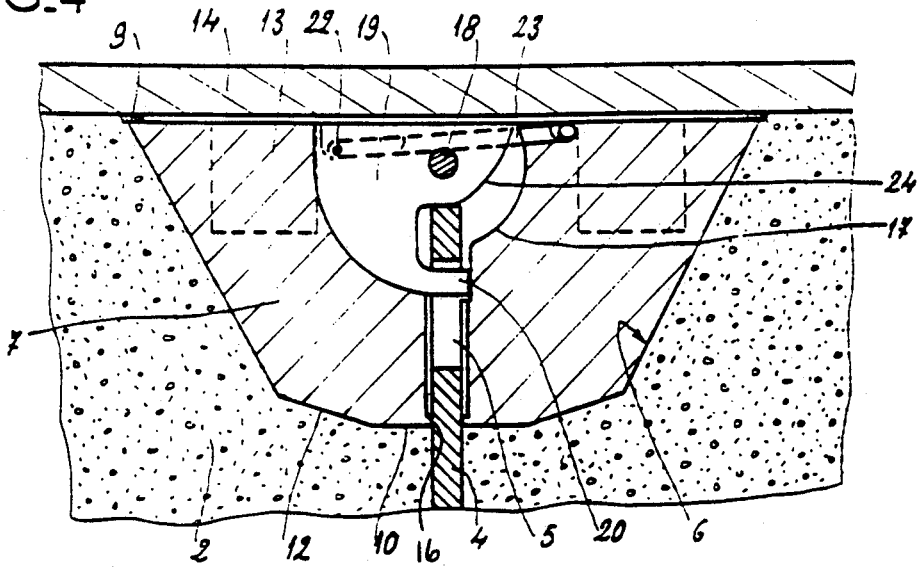
FIGS. 4 and 5 are two views in lengthwise section of the device, during pouring of the concrete and during removal from the form, respectively.

To ensure holding of element 3 inside the form and to form depression 6, a device is provided comprising a part 7 made of rigid but not brittle synthetic material, such as polyurethane, which has one flat face 8 delimited by a shoulder 9 and a shaped part that is essentially hemispherical. This shaped part comprises a bottom in the shape of a hull that has an edge 10 delimited by essentially flat surfaces 12. Four recesses are formed in flat face 8 of part 7, in which four magnets 13 are located, arranged symmetrically relative to the axis of the part. These magnets 13 are designed to hold the part 7 on a metal surface 14 of a form, as shown in FIG. 4. In the bottom of part 7, recess 15 having a generally rectangular shape opens, allowing rectangular end 4 of lifting element 3 to engage with sealing action. For this purpose, an edge delimiting this rectangular recess 15, near the base of part 7, is provided with a shoulder 16 designed to prevent penetration of the laitance between end 4 and part 7.

Face 8 of part 7 has a slot 17 extending as far as the upper part of lifting element 3. A latch 19 forming a bolt for lifting element 3 is mounted in slot 17 and is pivotable around an axis 18 and transverse to the slot. In the embodiment shown in the drawing, axis 18 of latch 19 is located along an extension of lifting element 3, and latch 19 comprises a hook 20 designed to engage the interior of eye 5 of lifting element 3. Latch 19 is shaped so that when hook 20 is engaged inside eye 5, as is the case in FIGS. 2 and 4, latch 19 is completely retracted inside slot 17, one of its edges fitting flush against flat face 8 of part 7.

Figure 5:
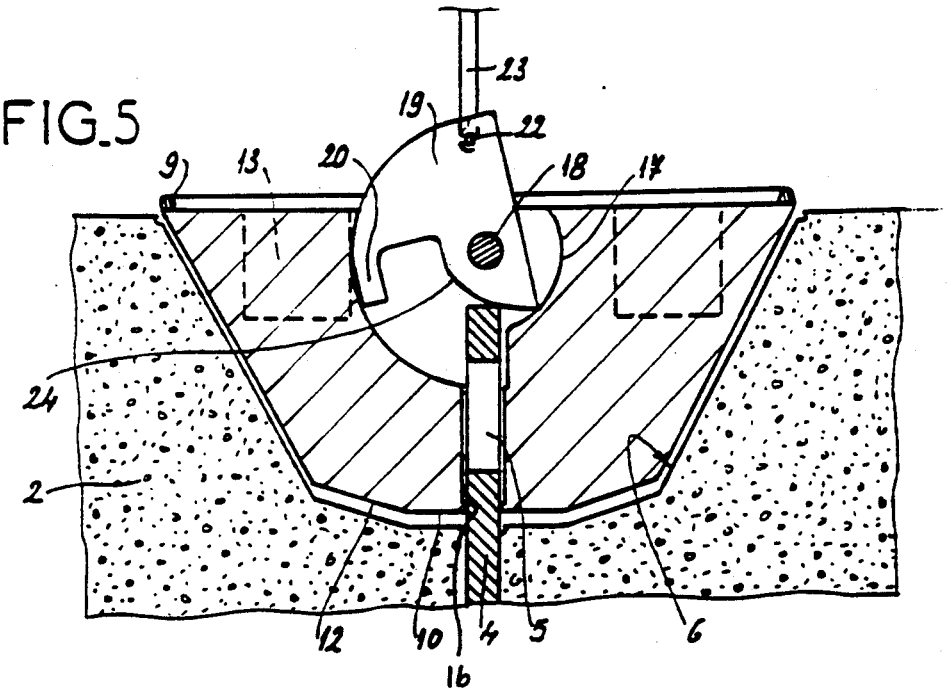

Near one of the ends of latch 19 there is a ring 23 articulated around an axis 22 parallel to axis 18 of locking element or latch 19. Ring 23 is capable of pivoting between a retracted position, shown in FIGS. 2 and 4, in which it does not project from flat face 8 of part 7 and a position in which it is pivoted outward through approximately 90°, forming an element for operating pivoting latch 19. It should be noted that latch 19 also comprises a shaped part 24 in the shape of a ramp, located above hook 20 and which, during pivoting of element 19 from a locked position to an unlocked position, abuts the upper edge of lifting element 3, as shown in FIG. 5, and tends to push part 7 out of depression 6 which it has just made in the concrete.

The device functions as follows. First, latch 19 is tilted toward its unlocked position before introducing lifting element 3 inside part 7. After positioning end 4 of element 3 in part 7, latch 19 is tilted toward its locking position, in other words from the position in which hook 20 engages eye 5 of lifting element 3. Ring 23 is retracted into the recess provided to receive it. The assembly is locked against the metal face of a form 14 as shown in FIG. 4, after which the concrete is poured and allowed to set before removal from the form. When removal from the form is complete, ring 23 is tilted through about 90° so that it can be grasped to tilt latch 19 toward its unlocking position as shown in FIG. 5, a movement during which ramp 24 abuts the end of the lifting element, aiding extraction of part 7 from depression 6, provided in the concrete. It is then possible to readily access eye 5 of the lifting element, thus permitting a suitable handling device to be inserted into its interior.

Figure 6:
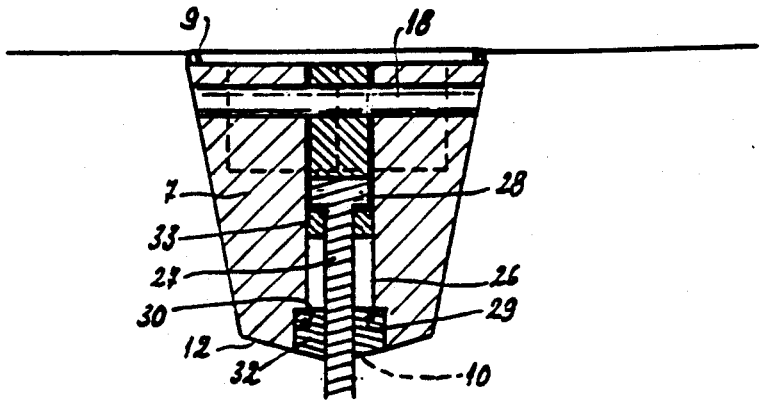
FIG. 6 is a cross section of a second device designed for holding a lifting element, in the form of an anchor with a head according to a second embodiment of the present invention.

FIG. 6 shows a variation of this device designed for temporarily holding a lifting element composed of an anchor with a head. In this device, the same elements are designated by the same reference numerals as above. Part 7 has a recess 26 with a circular section, designed to permit passage of the upper end of the lifting element which comprises a cylindrical rod 27 provided with an enlarged head 28. Recess 26 has a cross section corresponding to that of the enlarged head. The lower end of recess 26 is separated by a shoulder 29 formed in a zone 30 with a larger cross section which serves for the installation of a split collar 32 which surrounds rod 27 with sealing action and which abuts with sealing action enlarged part 30 of the recess.

In addition, locking element or latch 19 has the same general structure as that described above and has a locking element composed of a fork 33 whose two tines are designed to pass on either side of rod 27 beneath enlarged head 28. The use of this device is identical to that described above in the case of anchors with eyes except that sealing collar 32 is installed before pouring the concrete, and this collar is withdrawn after removing the temporary holding system.

As follows from the above, the invention provides a considerable improvement in existing technology by providing a device for temporarily holding a lifting element on a metal surface of a form, which has a simple structure, high reliability, which is not damaged by successive use, and which does not damage the form to which it is attached. Of course the invention is not limited to the embodiments of this device described above as examples; on the contrary, it includes all variations thereon.

What is claimed is:

1. Device for temporarily holding a lifting element on a surface of a form during concrete pouring and setting phases of a prefabricated concrete member, comprising:

a part having a flat face designed to abut the surface of the form, a shaped portion having a curved face extending from the flat face and designed to make a depression in the concrete member, a recess terminating in the curved face and extending orthogonally thereto for sealing engagement with a lifting element, and a slot terminating in the flat face;

a locking element pivotally mounted in the slot between a first locked position and a second unlocked position, with a pivot axis transverse to the slot, having a hook for retaining a free end of the lifting element when the locking element is in the first position; and means for ensuring movement of the locking element from the first position to the second position.

2. Device according to claim 1, wherein said flat face of said part includes magnets therein for attachment of said flat face of said device onto a metal surface of the form.

3. Device according to claim 2, wherein said magnets are at least two in number and are arranged symmetrically relative to a zone of said part which is designed to receive said lifting element.

4. Device according to claim 1, wherein said part is made of a rigid material which is not brittle.

5. Device according to claim 1, wherein said flat face of said part is delimited by a peripheral shoulder facing the surface of the form.

6. Device according to claim 1, wherein said shaped portion has a generally hemispherical shape having a bottom in the form of a hull with an edge delimited by surfaces which are essentially flat.

7. Device according to claim 1, wherein said locking element has an articulation axis located essentially halfway along said slot, aligned with an extension of said lifting element, said locking element comprising a ramp which, during pivoting of the locking element into the unlocked position, is designed to abut an upper edge of said lifting element.

8. Device according to claim 1, wherein said means for ensuring movement of said locking element comprises a ring mounted with articulation on said locking element, having an articulation axis parallel to an axis of articulation of said locking element, near an end of said locking element designed to project from said slot in the unlocked position, said ring being retractable in said flat face when said flat face is attached to a surface of a form.

9. Device according to claim 1, wherein said lifting element comprises an anchor with an eye having a transverse hole, said locking element comprises a hook designed to penetrate said hole, and said recess in said part has a rectangular section corresponding to that of an end of said lifting element, an edge of said recess being delimited by a shoulder designed to abut in sealing fashion with the end of said lifting element.

10. Device according to claim 1, wherein said lifting element having a circular section comprises a cylindrical rod equipped with an enlarged head, said locking element comprises a fork designed to overlap said rod and to abut below said head of said lifting element, said recess in said part has a circular section matching the circular section of said enlarged head, and a split collar surrounds said rod to ensure tightness between said rod and a bottom of the shaped portion of said part.

* * * * *